US005255915A

United States Patent [19]

Miller

[11] Patent Number: 5,255,915

[45] Date of Patent: Oct. 26, 1993

[54] SIX-CARD DRAW-POKER-LIKE VIDEO GAME

[75] Inventor: Gary Miller, Las Vegas, Nev.

[73] Assignee: United Gaming, Inc., Las Vegas, Nev.

[21] Appl. No.: 780,616

[22] Filed: Oct. 23, 1991

[51] Int. Cl.[5] ..... A63F 1/00

[52] U.S. Cl. ..... 273/85 CP; 273/138 A; 273/292

[58] Field of Search ..... 273/85 CP, 136 A, 292, 273/293

[56] References Cited

U.S. PATENT DOCUMENTS 4,743,022 5/1988 Wood ..... 273/85 CP 5,042,818 8/1991 Weingardt ..... 273/292

*Primary Examiner*—Jessica J. Harrison

*Attorney, Agent, or Firm*—Brown, Martin, Haller & McClain

[57] ABSTRACT

A method and apparatus are described for playing a six-card draw-poker-like game, played with a single deck of cards, in which there are a number of unique hands which require six cards. The invention uses a computer and a video screen. The computer contains a payout table defining winning hands (at least some of which use all six cards). The player makes a wager with the computer which then displays a first hand with a defined rank from the single deck; the player then decides whether to draw cards from the remainder of the deck or to take any winnings from the first hand. If the player draws, the computer produces a second hand, and then determines if the second hand is a winner and pays out or not accordingly. The game is therefore similar to poker in its playing strategy but offers a substantially greater variety of possible winning hands, especially in combinations not possible in conventional five card poker, and provides for a higher probability of winning hands at the lower hand values. This stimulates much greater interest by players, particularly casual players, who appreciate the greater variety of winning combinations and opportunities for winning, 16 Claims, 1 Drawing Sheet

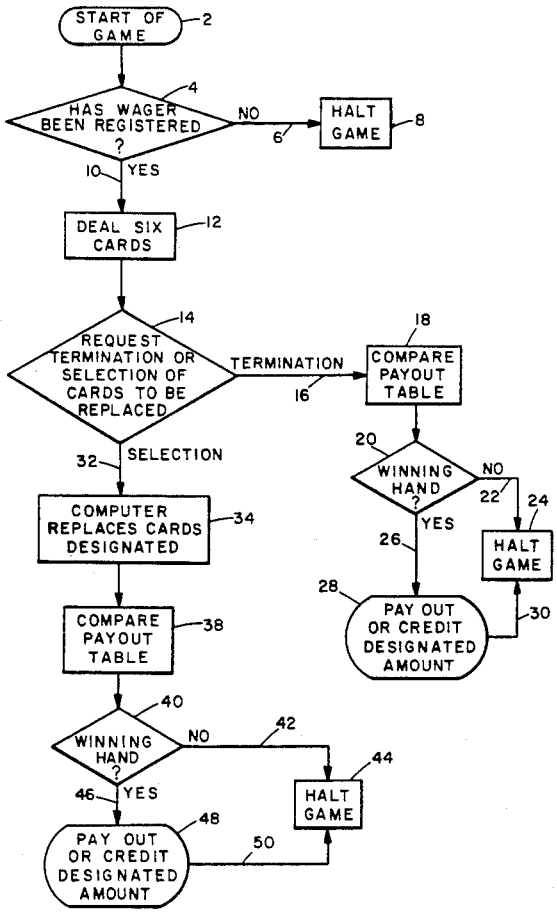

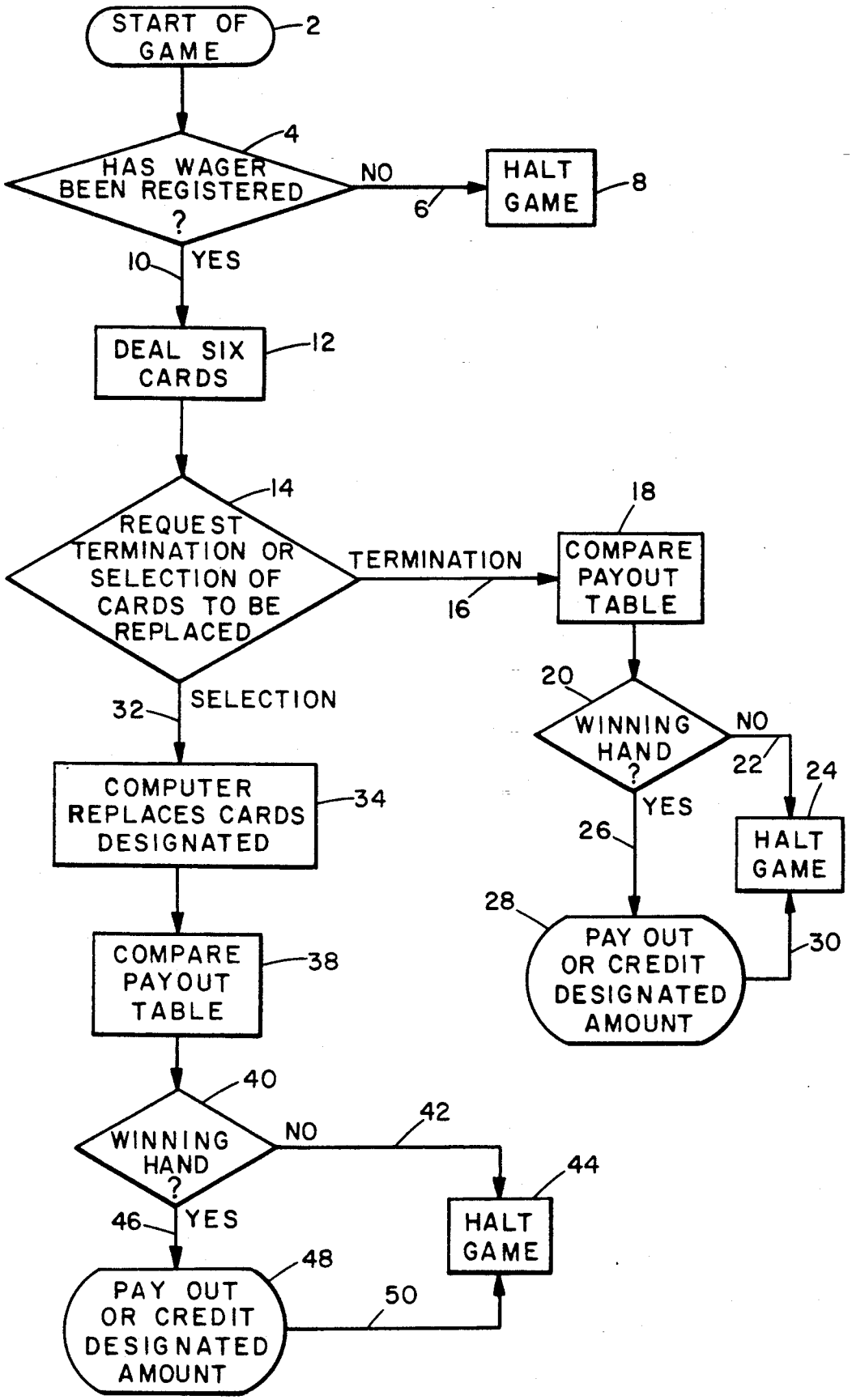
START OF GAME
2
HAS WAGER BEEN REGISTERED ?
4
NO
6
HALT GAME
8
10
YES
DEAL SIX CARDS
12
REQUEST TERMINATION OR SELECTION OF CARDS TO BE REPLACED
14
TERMINATION
16
COMPARE PAYOUT TABLE
18
WINNING HAND ?
20
NO
22
24
HALT GAME
YES
26
PAY OUT OR CREDIT DESIGNATED AMOUNT
28
30
32
SELECTION
COMPUTER REPLACES CARDS DESIGNATED
34
COMPARE PAYOUT TABLE
38
WINNING HAND ?
40
NO
42
44
HALT GAME
46
YES
PAY OUT OR CREDIT DESIGNATED AMOUNT
48
50

SIX-CARD DRAW-POKER-LIKE VIDEO GAME

BACKGROUND OF THE INVENTION

1. Field of the Invention

The invention herein relates to video games in which a simulated hand of cards is displayed and a predefined payout table determines whether the hand is a winning or losing hand and how much a winning player is to be paid.

2. Description of the Prior Art

There have been many variations of poker games in the past. One of the most common and popular is draw poker, in which the player has the opportunity to substitute or more of the cards originally dealt in an effort to improve the value of the hand.

All poker games, however, are defined by a well-known ranking of hands based on combinations of five cards from a standard 52-card deck. No winning poker hand contains more than five cards. Even where wild cards are introduced, they merely substitute for cards in the defined combinations and do not create new or broader combinations.

In the past there have been poker games which allow a player to be dealt more than five cards These are usually stud poker games, the most common of which is seven card stud poker. Occasionally, one also finds draw poker games in which more than five cards are dealt, but these are relatively uncommon and often involve the use of a second or additional decks of cards. However, dealing of extra cards has not altered the fundamental play of the game. Even with six or more cards in his or her hand, the player must select only five to compete in the game. Any combination of more than five cards in meaningless in conventional poker The introduction of computerized poker games in which the player sees the representation of the hand dealt in simulation on a video screen and usually plays against a standard payout table retained in the computer's memory (rather than against other players) does not change this underlying limitation of the poker game. The number of combinations possible in a five card poker game means that, even at the lower value levels (such as two pair and three of a king), the player has a relatively low probability of having a winning hand, even though those lower ranked hands are the ones which occur most frequently.

It would therefore be advantageous to have a video game which would be similar to poker in its playing strategy but which would offer substantially greater variety of possible winning hands, particularly in combinations not possible in conventional five card poker, and which would also provide for a higher probability of winning hands at the lower hand values. Such a game would stimulate much greater interest by players, particularly casual players, who will find the greater variety of combinations and the greater opportunities for winning to be exciting.

SUMMARY OF THE INVENTION

In one of its aspects, the invention herein is a method of playing a poker-like game in which a winning hand generates a payout to a player using a computer and a video screen. The method comprises first providing a payout table defining a predetermined set of winning hands of different ranks and payout values selected from a single deck of cards, each card having a different face value and suit, with at least some of the winning hands being combinations of six cards, with the remaining hands from the deck not included within the predetermined set of winning hands not having any payout value. Thereafter the play requires registering a wager with the computer; generating and displaying on the video screen a visual representation of a first hand of six cards randomly selected from the deck of cards; determining the rank of the first hand with respect to the payout table from the face value and suit of each represented card; and enabling the player to terminate the game or designate at least one of the represented cards in the first hand to be replaced with a corresponding number of other represented cards randomly generated from the remaining cards in the deck and displayed on the video screen, the unreplaced cards from the first hand and the replacement cards forming a second hand of six cards, with the second hand replacing the first hand; if such replacement is performed determining the rank of the second hand with respect to the payout table from the face value and suit of each represented card and thereafter terminating said game; and upon termination after the first or second hand providing the predetermined payout to the player according to the value of the remaining hand of cards as defined by the payout table.

In another aspect, the invention comprises apparatus for playing a poker-like game in which a winning hand generates a payout to a player. The apparatus comprises a computer and a cooperating video screen, the computer having: a storage memory; means to display card identification information on the video screen; a payout table stored in the memory and defining a predetermined set of winning hands of different ranks and payout values selected from a single decks of cards, at least some of the winning hands containing six cards, each card having a face value and suit, with the remaining combinations of six cards from the deck not included within the predetermined set of winning hands not having any payout value; and comparison means to compare the payout table information stored in the memory with card identification information displayed on the video screen.

The apparatus also includes means for a player to register a wager with the computer, in response to which the computer generates and displays on the video screen a representation of a first hand of six cards randomly selected from the deck of cards, the first hand having a rank with respect to the payout table determined from the face value and suit of each represented card; means for enabling the player to designate at least one of the cards in the first hand for replacement with the representation of a corresponding number of cards randomly generated from the remaining cards in the deck and displayed on the video screen, the unreplaced cards from the first hand and the replacement cards forming a second hand of six cards, the second hand replacing the first hand, the second hand also having a rank with respect to the payout table of the second hand determined from the face value and suit of each represented card; and means for terminating the game after the first or second hand.

Finally, the apparatus also comprises means for dispersing to the player upon termination of the game after the first or second hand items representing the payout value of the remaining first or second set of cards as defined by the payout table, the dispersement being made after comparison by the comparison means of the identity of the rank of the remaining hand with the identities of the winning hands defined by the payout table.

In preferred embodiments, both the method and the apparatus provide for accumulation by the player of credits for hands won, to draw against such credits for wagers for subsequent games, and to be paid an equivalent monetary payout for such accumulated credited winnings at a time indicated by the player.

BRIEF DESCRIPTION OF THE DRAWINGS

The single figure of the drawing is a flow chart schematically illustrating the steps in the operation of a single hand of the video game of this invention.

DETAILED DESCRIPTION AND PREFERRED EMBODIMENTS

The game method and apparatus defined herein are based on a unique concept of a six card poker-like game in which a hierarchy of card hands to be dealt from a single deck are defined. Some of these hands are equivalent to those played in regular five card poker, while others are new creations which it is not possible to play in regular five card poker. All hands of this game, both the newly created hands and the hands equivalent to five-card poker, are defined in Table I below. Names used are analogous to the names used in conventional five card poker, but all hands named "straights" and "flushes" in the present game require the inclusion of six cards. The single deck to be used is a conventional 52-card deck; the game as defined does not permit the use of jokers or wild cards. All combinations must be made with designated number or face cards.

TABLE I

HANDS AND PROBABILITY OF OCCURENCE

| HAND | 5-CARD POKER | THIS 6-CARD GAME |
|---|---|---|
| Royal Flush | | |
| 5 cards | 0.0000229[a] | N/W[b] |
| 6 cards | N/P[c] | 0.00000570 |
| Straight Flush | | |
| 5 cards | 0.0000831 | N/W |
| 6 cards | N/P | 0.0000265 |
| Four of a Kind; Jacks or better; Pair Kicker | N/P | 0.000259 |
| Four of a Kind; Pair Kicker | N/P | 0.000526 |
| Double Three of a Kind | N/P | 0.001178 |
| Four of a Kind | 0.00237 | 0.00503 |
| Full House | 0.0117 | 0.0525 |
| Flush | | |
| 5 cards | 0.0107 | N/W |
| 6 cards | N/P | 0.00231 |
| Three Pair | N/P | 0.0158 |
| Straight | | |
| 5 cards | 0.0107 | N/W |
| 6 cards | N/P | 0.00449 |
| Three of a Kind | 0.0746 | 0.0941 |
| Two Pair | 0.130 | 0.261 |
| Pair, Jacks or Better | 0.219 | 0.186 |
| Bust (no Winning hand) | 0.541 | 0.377 |

Notes:
[a]All probabilities are rounded to three significant figures.
[b]N/W = not defined as a winning hand.
[c]N/P = not playable in 5-card poker.

The probabilities shown in the above table illustrate the advantages of the new game. Seven new hands exist which cannot be played in five card poker. These are a six card royal flush, a six card straight flush, six card four of a kind with jacks or better and a pair kicker, six card four of kind wit a pair kicker, double three of a kind, a six card flush, and a six card straight. The straight and flushes, when compared against the five card straights and flushes, will be seen to be significantly less probable of occurrence and, therefore, will result in significantly higher proportional payout (as will be seen in Table II below), thus being much more enticing to the typical player. Similarly, the presence of the two new four of a kind combinations and the double three of a kind represent wholly new sources of payout for players, which also will significantly increase the interest in the game.

Conversely, at the lower hand values, such as three of a kind and two pair, the probability of obtaining winning hands is significantly greater (double in the case of two pair) because of the player's potential for winning attributable to the ability to utilize six cards instead of five. The player can thus have more incentive to draw cards from the single deck in an attempt to create these lower level winning hands, especially where in five card poker the initial hand would have been considered to be of too little potential to create anything significant by the draw. This presents an added attraction for the casual or novice player, since it allows the player to have a greater chance of having winning hands more frequently, and thus retaining the player's interest in continuing the game.

The seeming anomaly of the lower probability of the pair of jacks or better hand in the present game is a direct result of the presence of the additional new hands and the higher probability of having or creating a winning three of a kind or higher two pair hand. In short, it is simply easier to get a winning hand in the present game which has a higher value than one pair than it is to get a higher value hand from a single deck in a standard five card poker game.

The same overall effect of the greater number of winning combinations in the present game is also reflected in the lower probability of getting a bust hand with no winning combination.

The play of the game may be readily understood from the flow chart of the drawing, which represents the actions of the computer program embodying the game procedure and its interaction with the player. At 2 the player starts the game, either by making a wager, by pushing a button, by touching an on-screen touch sensor or by otherwise electronically or mechanically signaling to the computer to initiate the program. The wager may be made by deposit of a coin or token or by signaling the use previously accumulated credits from prior winnings. The computer at 4 determines whether or not a wager has been registered by the player. If not, the program via 6 will halt the game at 8. Preferably, however, the program will provide an onscreen prompt to the player reminding the player that a wager is required. If no wager is still forthcoming within a predetermined time period (perhaps 10–15 seconds) the program then proceeds to halt the game at 8.

Once a wager has been recorded via 10 the program then deals six cards to the player in the form of representations of card faces appearing on the video screen. The method of determining the cards to be dealt is normally by means of random number generation within the computer program, where each card in a single conventional 52-card deck is assigned a unique numerical designation within the program. The output of the random number function within the program then is compared with the table of card designations within the program, the card having that specific numerical designation identified, and the card representation of that card displayed on the screen. A blocking function will also be present such that once a card representation has been made for a given hand, that card representation will not be generated again during the hand, even if repeated runs of the random number function generate the card's identification designation. This prevents the appearance of the same card twice in the same hand, a situation which of course is not part of play in poker or poker-like games. Therefore, when the random number function generates a number which is not identified with any card in the card identification table or when it generates a number for a card which has already been represented on the screen during that hand, the random number function is automatically reset and continues to generate numbers through repeated iterations until a number representing an unused card is generated and that card is then represented on the screen at 12. The speed of the system is such that the player is not aware of such iterations; all six cards appear so quickly on the screen that to the player they appear to have become visible simultaneously.

Once six cards have been dealt at 12 the player is given the opportunity at 14 to examine this hand and determine whether or not he or she wishes to play the hand as is or draw additional cards. Since this is a draw game, the presence of the time interval at 14 does not automatically terminate the game and produce a payout, even though the hand displayed on the screen may be a winning ("pat") hand. This is because it is within the player's prerogative to determine if he or she wishes to forfeit the displayed hand in the hope of drawing to create a yet higher ranking hand in the draw portion of the game cycle.

If the player is satisfied with the value of the first hand and elects to play that first hand as shown, he or she at 16 signals the computer to terminate the game, such as by pushing a designated button or an onscreen touch sensor. The program then compares the predetermined payout table at 18 with the first hand to determine at 20 if the hand is a Winning hand. If the determination at 22 is that the hand is not a winning hand the game is halted at 24 with no payout to the player. On the other hand, if the hand at 26 is determined to be a winner, the appropriate payout is determined from the payout table and is paid or credited at 28 to the player, following which the game is halted as indicated at 24 via 30. Having no payout available at 22 for a non-winning hand will be rarely invoked, since it is unlikely that the player at 14 will decide to terminate the game if the first displayed hand is not a winning hand. It is possible, however, that a player may wish to terminate the game early without a winner or may erroneously believe that the hand displayed is a winning hand and therefore elect to terminate.

(Alternative, there need not be a separate "terminate" button or sensor at 14. Rather the player may in effect play the first hand by not designating any cards for replacement and then indicating "selection" 34 as discussed below. The program will then deal no replacement cards but will record the hand now as the "second" hand, and the game will terminate as described.)

Normally, however, the player upon examining the first displayed hand at 14 will terminate the game only if he or she believes the hand is a winning hand of sufficient value that the potential of obtaining a better hand by drawing to the hand is sufficiently great that the player is willing to forego the initial winning amount and continue to the second portion of the game. If upon inspection at the hand at 14, the player either determines that the hand as displayed is a bust (i.e. non-winning hand) or is of sufficiently low value that the player feels that he or she can better the hand by drawing to it, the player will select at 32 at least one card of the first hand to be replaced. The game may be set so as to allow all of the six cards of the first hand to be replaced, or optionally will be set to permit a lower maximum number of cards—usually four or five—which can be replaced. Commonly video games of the draw type provide either a row of buttons or touch screen sensors with one button or sensor beneath each represented card so that the player can indicate which of the cards are to be replaced. In a similar, but less preferred alternative, each card can be displayed one at a time and the player prompted to designate whether or not that card is to be replaced. This alternative is less preferred, unless there is means also to continually display all cards on the screen, since most players wish to be able to see the entire hand at once while determining what cards to discard and draw to. One method of making this alternative more attractive would be to have the computer highlight each card in turn on the screen, while retaining the representation of all of the remaining cards, so that as each card is highlighted the player can observe the progress of the discard pattern and consider the changed potential for a better second hand.

Once the player has indicated at 32 which cards are to be discarded and replaced at 34, the program will deal the designated number of replacement cards from the remaining cards left in the deck. Dealing is again by random number generation as described above, with blocking to prevent regeneration of representations of cards already dealt.

Once this second hand is dealt, the program determines automatically by comparison of the second hand with the payout table at 38 whether or not the second hand is a winning hand at 40. The automatic determination occurs since the player has no further opportunity to draw new cards and the first hand has been forfeited. Thus, if the second hand as determined at 40 is not a winner as indicated at 42, the game is halted at 44 and there is no payout. However, if at 46 it is determined that there is a winning hand, the system will at 48 pay out or credit the appropriate amount as determined by the payout table, following which the game will be halted at 44 via 50 and reset for the start of another hand at 2.

The comprehensive payout table is initially constructed in the computer's memory before the apparatus is put into use. The table remains unchanged throughout the like of the apparatus, unless the owner of the apparatus decides to alter the payouts or a regulatory agency sets different requirements for payouts. The players cannot alter the payout table by their play. The payout table will identify all possible winning combinations (hands) and the appropriate payout amount for each winning combination, based primarily on the probability of that combination occurring. Payout tables are commonly displayed on the screen or on a glass or panel of the game cabinet, so that the player is aware of the reward he or she is playing for. A typical payout table is shown Table II on the next page.

TABLE II

| HAND | TYPICAL PAYOUT TABLE 5-CARD POKER | THIS 6-CARD GAME |
|---|---|---|
| Royal Flush with maximum coins played | | |
| 5 cards | 800 | N/W[a] |
| 6 cards | N/P[b] | 25000 |
| Royal Flush | | |
| 5 cards | 250 | N/W |
| 6 cards | N/P | 1000 |
| Straight Flush | | |
| 5 cards | 50 | N/W |
| 6 cards | N/P | 250 |
| Four of a Kind; Jacks or better; Pair Kicker | N/P | 40 |
| Four of a Kind; Pair Kicker | N/P | 20 |
| Double Three of a Kind | N/P | 10 |
| Flush | | |
| 5 cards | 5 | N/W |
| 6 cards | N/P | 8 |
| Four of a Kind | 25 | 6 |
| Straight | | |
| 5 cards | 4 | N/W |
| 6 cards | N/P | 5 |
| Three Pair | N/P | 4 |
| Full House | 8 | 3 |
| Three of a Kind | 3 | 2 |
| Two Pair | 2 | |
| Pair, Jacks or Better | 1 | 1 |
| Bust (no winning hand) | 0 | 0 |

Notes:
[a]N/W = not defined as a winner.
[b]N/P = not playable in 5-card poker.

The payout with "maximum coins" relates to those gaming operations which permit a player to wager more than one coin per wager. There is normally a cap on the total number of coins that can be wagered per wager; typical caps are 5–7 coins. Payouts are increased for a given winning hand when the player has wagered multiple numbers of coins rather than a single coin. In Table II above, the multiple coin wager payout is exemplified only for the highest value hand, the royal flush. However, if desired multiple coin wagers can also be provided for on some or all of the other hands, such that they would also result in proportionately enhanced payouts.

Payout is commonly in one of two forms, usually depending on whether monetary payout (gaming) is permitted in the local jurisdiction. First, a player can be awarded credits which can be entered into the computer's memory and a accumulated to be displayed on the screen either continually, at the end of each hand, or at the player's designation, through appropriate signaling means in the computer/user interface. Such would serve, for instance, in a home version of the game or in a public version which is to be used solely for entertainment purposes, where the credits would represent "points" and the player would compete for a high point total. In such games it is common for the system memory to retain the highest previously obtained point totals, and to display them to the player, so that the player can in effect compete against prior players.

It is also desirable in gaming to have such credits represent money won and to let such credits accumulate and be displayed on the screen, and to have means by which the player can designate wagers from such accumulated points or credits. This can allow the player to measurably increase the number of games played when on a winning streak, since the player need not stop to insert additional coins between each play. This substantially increases the attraction of the game for the player. In this case the actual monetary payout would not come until the player indicates, through pushing a designated button or touching a designated touch panel, that he or she is finished with the present play sequence and wishes to be paid the accumulated credited winnings.

Ultimately, where the apparatus is to be used in locations where gaming is permitted, the payout will be in the form of coins or tokens representing value (collectively referred to as "winnings indicators") returned for each equivalent token or coin initially played at the time of the wager. In the latter case, the apparatus of the game will also include appropriate conventional mechanical means to accumulate and dispense some or all of the coins awarded for each winning hand, either at the time that the winning hand is obtained (i.e., payout for each hand) or at the time that the player indicated a desire for payment of the accumulated winnings. Such mechanisms are widely used in five card poker video games, slot machines and the like devices.

It will be evident that there are numerous embodiments of the apparatus and playing method of this invention which, while not expressly described above, are clearly within the scope and spirit of the invention. Consequently the above description is to be considered exemplary only, and the actual scope of the invention is to be determined solely from the appended claims.

I claim:

1. A method of playing a draw-poker-like game in which a winning hand generates a payout to a player using a computer and a video screen, which comprises:

providing a payout table defining a predetermined set of winning hands of different ranks and payout values selected from a single deck of cards, each card having a different face value and suit, with at least some of said winning hands being combinations of six cards, with the remaining hands from said deck not included within said predetermined set of winning hands not having any payout value;

registering a wager with said computer;

generating and displaying on said video screen a visual representation of a first hand of six cards randomly selected from said single deck of cards;

determining the rank of said first hand with respect to said payout table from the face value and suit of each represented card;

enabling said player to terminate the game or to designate at least one of said represented cards for replacement;

if said designation is registered, in response thereto replacing said at least one designated cards in said first hand with a corresponding number of other represented cards randomly generated from the remaining cards in said single deck and displayed on said video screen, the unreplaced cards from said first hand and said replacement cards forming a second hand of six cards, with said second hand replacing said first hand;

determining the rank of said second hand with respect to said payout table from the face value and suit of each represented card and thereafter terminating said game; and upon termination after said first or second hand providing said predetermined payout to said player according to the value of the remaining hand of cards as defined by the payout table.

2. A method as in claim 1 wherein said six card hands comprise six card straights and flushes.

3. A method as in claim 1 wherein said six card hands comprise double three of a kind and three pairs.

4. A method as in claim 1 wherein said wager may involve a multiple of wager indicators being wagered simultaneously.

5. A method as in claim 1 wherein at least some of said hands have greater probabilities of occurring than do comparable hands in five card poker.

6. A method as in claim 1 wherein there is a predetermined maximum number of cards which can be replaced following said representation of said first hand.

7. A method as in claim 1 wherein said upon the occurrence of a winning hand, the predetermined payout is displayed in the form of credits representing monetary value, and said monetary value is subsequently disbursed to said player upon request therefore by the player.

8. A method as in claim 1 wherein said monetary value is disbursed in the form of coins or tokens, said tokens being redeemable for money.

9. Apparatus for playing a draw-poker-like game in which a winning hand generates a payout to a player, which apparatus comprises:

a computer and a cooperating video screen, said computer having a storage memory, means to display card identification information on said video screen, a payout table stored in said memory and defining a predetermined set of winning hands of different ranks and payout values selected from a single deck of cards, at least some of said winning hands containing six cards, each card having a face value and suit, with the remaining combinations of six cards from said deck not included within said predetermined set of winning hands not having any payout value; and comparison means to compare the payout table information stored in said memory with card identification information displayed on said the video screen;

means for said player to register a wager with said computer, in response to which said computer generates and displays on said video screen a representation of a first hand of six cards randomly selected from said single deck of cards, said first hand having a rank with respect to said payout table determined from the face value and suit of each represented card;

means for enabling said player to designate at least one of said represented cards in said first hand for replacement with the representation of a corresponding number of cards randomly generated from the remaining cards in said single deck and displayed on said video screen, the unreplaced cards from said first hand and said replacement cards forming a second hand of six cards, said second hand replacing said first hand, said second hand also having a rank with respect to the payout table of said second hand determined from the face value and suit of each represented card;

means enabling said player to terminate the game after said first or second hand; and means for dispersing or displaying to said player upon termination of the game items, credits or indicia representing the payout value of the remaining first or second hand of cards as defined by said payout table, the dispersement or display being made after comparison by the comparison means of the identity of the rank of said remaining hand with the identities of the winning hands defined by said payout table.

10. Apparatus as in claim 9 comprising means to represent six card hands comprising six card straights and flushes.

11. Apparatus as in claim 9 comprising means to represent six card hands comprising double three of a kind and three pairs.

12. Apparatus as in claim 9 also comprising means to accept wagers comprising a multiple of wager indicators being wagered simultaneously.

13. Apparatus as in claim 9 comprising means to represent hands having greater probabilities of occurrence than do comparable hands in five card poker.

14. Apparatus as in claim 9 comprising means to limit the maximum number of cards which can be replaced following representation of said first hand.

15. Apparatus as in claim 9 comprising means for displaying the predetermined payout of a winning hand in the form of credits representing monetary value, and means for thereafter disbursing said monetary value to said player upon request therefore by the player.

16. Apparatus as in claim 15 further comprising means for storing at least a portion of said monetary value in the form of coins or tokens, said tokens being redeemable for money.

* * * * *